US005467791A

United States Patent [19]

Kato et al.

[11] Patent Number: 5,467,791

[45] Date of Patent: Nov. 21, 1995

[54] ULTRASONIC CLEANING METHOD AND DEVICE THEREFOR

[75] Inventors: Hiroaki Kato, Koshigaya; Hideaki Heki, Yokohama; Shirou Komura, Fujisawa; Emiko Okamura, Yokohama, all of Japan

[73] Assignee: Kabushiki Kaisha Toshiba, Kawasaki, Japan

[21] Appl. No.: 199,658

[22] Filed: Feb. 22, 1994

[30] Foreign Application Priority Data

Feb. 22, 1993 [JP] Japan ..... 5-031017

[51] Int. Cl.[6] ..... B08B 3/10

[52] U.S. Cl. ..... 134/166. C; 134/184

[58] Field of Search ..... 134/1, 184, 113, 134/166 C, 1.1–1.3, 22.12; 366/197

[56] References Cited

U.S. PATENT DOCUMENTS

| | | | |
|---|---|---|---|
| 2,980,123 | 4/1961 | Lemelson | 134/184 |
| 4,753,257 | 6/1988 | Gabriel et al. | 134/184 |
| 4,806,277 | 2/1988 | Sakurai | 134/184 X |
| 5,069,235 | 12/1991 | Vetter | 134/113 |
| 5,289,838 | 3/1994 | Odell | 134/166 R |

FOREIGN PATENT DOCUMENTS

| | | | |
|---|---|---|---|
| 311668 | 10/1971 | U.S.S.R. | 134/184 |
| 530664 | 12/1976 | U.S.S.R. | 134/184 |
| 1147459 | 3/1985 | U.S.S.R. | 134/184 |

*Primary Examiner*—Frankie L. Stinson

*Attorney, Agent, or Firm*—Oblon, Spivak, McClelland, Maier & Neustadt

[57] ABSTRACT

An ultrasonic cleaning device for cleaning a fuel assembly constituting an item to be cleaned, includes: a plurality of ultrasonic transducers which irradiate the outside of this item to be cleaned with ultrasonic waves from at least two directions; an ultrasonic transducer translating mechanism which moves ultrasonic transducers vertically along a support member and which is provided with a steel housing constituting an ultrasonic wave reflecting structure which reflects ultrasonic waves from ultrasonic transducers towards the item to be cleaned a feed pump arranged outside the item to be cleaned and constituting a cleaning liquid supply mechanism which supplies cleaning liquid in a pressurized condition into the interior of the item to be cleaned; and a discharge pump including a cleaning liquid discharge mechanism that discharges cleaning liquid from the cleaning liquid supply mechanism to a filter device.

23 Claims, 12 Drawing Sheets

EFFECT OF ULTRASONIC WAVE REFLECTING STRUCTURE

ULTRASONIC CLEANING METHOD AND DEVICE THEREFOR

BACKGROUND OF THE INVENTION

1. Field of the Invention

This invention relates to a method and device for ultrasonic cleaning which efficiently separates and removes radioactive solids such as crud or scale adhering to the various members, in particular hollow square-shaped members, which make up a light-water reactor atomic power plant by irradiating them with ultrasonic waves.

2. Discussion of the Background

One example of a light-water reactor atomic power plant is a boiling water reactor (hereinbelow abbreviated as BWR). Typically this is constructed as follows. A reactor pressure vessel contains a reactor core and cooling water. The reactor core consists of a plurality of fuel assemblies and control rods etc. The cooling water flows upwards over the core and is heated by the heat of the nuclear reaction of the core. The heated cooling water assumes a two-phase flow condition consisting of water and steam and is introduced into a steam/water separator arranged above the core, where the water and steam are separated. The separated steam is further passed into a steam drier arranged above the separator, where it is dried to produce dry steam. This dry steam is supplied for power generation by being fed to a turbine system through a main steam pipe connected to the reactor pressure vessel After being used in the turbine to generate electricity, the steam is fed to a condenser where it is condensed, liquefied and returned to condensate. The water which was separated in the steam/water separator flows down through a downcomer and is mixed with the feedwater returned from the turbine system and fed to a location below the core. The above cycle is then repeated.

In an atomic power plant, corrosion products generated by corrosion of the various pipes and equipment etc. which make up the atomic power plant are the main cause of radiation exposure. These corrosion products acquire their radioactivity by being irradiated by the fuel assemblies, to which they adhere when they are transported to the fuel assemblies by the cycle described above. Some of these irradiated corrosion products then separate from the fuel assemblies and become suspended in the coolant water in the reactor or are dissolved, etc. and dispersed in the atomic power system so as to adhere to the pipes and equipment, raising the proportion of radioactivity in the atmosphere. This results in radioactive exposure when workers enter this atmosphere. Removal of such radioactive crud or scale adhering to the fuel assemblies and various items of equipment is therefore very effective in greatly reducing the amount of exposure to radioactivity in an atomic power plant. Removal of this radioactive crud is also important in the case of fuel, from the point of view of preventing dispersal of radioactive pollutants during handling, when moving spent fuel out into spent fuel storage installations or into nuclear fuel reprocessing plants etc. Equipment onto which radioactive corrosion products adhere can be classified into square-shaped hollow items such as fuel racks, which hold the fuel assemblies, and cylindrical items such as pipes. This description is concerned in particular with a cleaning technique for removing corrosion products adhering to square-shaped hollow items.

Taking a fuel assembly as an example of a square-shaped hollow item, a prior art fuel assembly cleaning device will now be described. One example is a water-spray cleaning device as disclosed in issued Japanese Patent Publication Sho. (Tokko-Sho) 58-17440. This device will be described with reference to FIG. 1 and FIG. 2. FIG. 1 is a view showing the overall layout of the entire device. In FIG. 1, a wash chamber 1 is illustrated. This wash chamber 1 is of an elongate cylindrical shape such as to surround a fuel assembly 2 and spray nozzle head 3. As shown in FIG. 2, a spray nozzle head 3 is equipped with a square-section through-hole 4 matching the shape of fuel assembly 2, the fuel assembly 2 being inserted within this through-hole 4. A plurality of spray nozzles 5 are mounted on the inner circumference of through-hole 4. After removing the channel box, high pressurized water is sprayed onto fuel assembly 2 through the plurality of spray nozzles 5. Spray nozzle head 3 is mounted such that it can be raised and lowered along wash chamber 1. The construction of a drive unit which carries out this raising and lowering action is described below. A motor 8 is arranged on a floor 7 above a fuel pool 6, gearing 9 being coupled to a rotary shaft of this motor 8. This gearing 9 is coupled to a screw bar 11 by means of a swivel joint 10. A nut 12 mounted on spray nozzle head 3 is threaded onto this screw bar 11. Reference numeral 13 denotes a guide bar for ensuring that spray nozzle head 3 is driven vertically. Thus, when motor 8 is started up, its rotation is reduced by gearing 9, its transmission direction is converted, and it is transmitted to screw bar 11 through swivel joint 10. By rotation of this screw bar 11, spray nozzle head 3 is raised and lowered vertically, by means of a nut 12, while being guided by guide bar 13.

A water feed unit is connected to spray nozzle head 3 and highly pressurized water is fed from this water feed unit. In more detail, a water feed pump 14 is arranged on floor 7 and pool water **6*b* in fuel pool 6 is sucked in through suction pipe 15 by this water feed pump 14. Pool water 6*b* which is sucked in is fed to each nozzle 5 of spray nozzle head 3 through a blowdown hose 17 so that highly pressurized water can be sprayed from these nozzles onto fuel assembly 2**.

A drainpipe 19 is arranged at the bottom **6*a* of fuel pool 6. Reference numeral 19 in FIG. 1 denotes a centrifugal separator. Centrifugal separator 19 and the bottom of wash chamber 1 are connected through a manifold 20. An underwater vacuum pump 21 is inserted in this manifold 20. A crud receiver 24 is connected through outlet nozzle 22 and a remotely operated disconnective joint 23 to a lower portion of centrifugal separator 19. In FIG. 1, reference numeral 25 indicates an opening, and 26 indicates a support which supports the fuel assembly 2 from below. Pool water 16 containing crud which flows out from below fuel assembly 2 is fed into centrifugal separator 19 where it is separated into clean pool water and a solid fraction (separated crud). The pool water 16 is discharged through opening 25 into fuel pool 6 while the solid fraction is collected in crud receiver 24**.

However, a fuel assembly cleaning device constructed as discussed above is subject to the following problems:

(1) Since the high pressurized water is sprayed from outside the fuel assembly within wash chamber 1 under a condition wherein the channel box removed from fuel assembly 2, or with a fuel assembly which originally does not have a channel box mounted within wash chamber 1, the highly pressurized water is prevented from penetrating into the interior because it is obstructed by the fuel rods outside the fuel assembly. This prevents crud adhering to fuel rods which are located on the inside of the fuel assembly from being removed.

(2) A large amount of highly pressurized water is needed in cleaning fuel assembly 2. This means that water feed pump 14 and/or underwater vacuum pump 21 which is used for removing the water which is supplied are very large in size and thus difficult to handle. Furthermore anxieties exist regarding being able to guarantee the necessary installation space and regarding contamination of these devices themselves, leading to the concern that large amounts of radioactive waste etc. may be generated.

(3) During the cleaning process the channel box has to be mounted and removed. This complicates the operation and increases exposure of the workers. Furthermore there are safety problems due to the increased possibility of damaging the fuel rods since fuel is manipulated with the channel box removed.

(4) The amount of solids adhering to the fuel tends to be decreased in modern plants thanks to management of water quality etc. but adhesion is stronger. This means that one cannot expect to obtain the same cleaning efficiency as in conventional plants.

Another practical example using ultrasonic waves will now be described. Examples of fuel cleaning using ultrasonic waves are: Early Japanese Patent Publication Sho. (Tokkai-Sho) 55-104799, Early Japanese Patent Publication Sho. (Tokkai-Sho) 59-58399, Early Japanese Utility Model Publication Sho. (Jitsukai-Sho) 60-113600 and the publication entitled "Feasibility of Using Nonchemical Methods to Decontaminate Fuel Rods": EPRI NP-4122, June 1985. EPRI NP-4122 will now be described with reference to FIG. 3 and FIG. 4. Reference numeral 31 in FIG. 3 denotes a wash chamber. A fuel assembly 32 and ultrasonic transducer 33 are disposed within this wash chamber 31. Fuel assembly 32 and ultrasonic transducer 33 are arranged parallel to each other, so that the ultrasonic waves are incident at right angles on the surface of the fuel assembly. An ultrasonic generator 34 is connected to ultrasonic transducer 33 by means of a cable 37. Ultrasonic transducer 33 can be raised and lowered along a guide 36 by means of a translating mechanism 35. That is, ultrasonic waves are directed onto fuel assembly 32 while raising and lowering the ultrasonic transducer 33, thereby removing crud adhering to the fuel rods. A filter 39 is connected to the foot of wash chamber 31 through a drainpipe 38. A pump 41 is connected to this filter 39 through pipe 40. Delivery pipe 42 of this pump 41 is connected to the top of wash chamber 31.

With the above construction, radioactive crud adhering to fuel assembly 32, constituting a square-shaped article to be cleaned, is removed while raising and lowering the ultrasonic transducer 33. The crud which is removed flows down together with the pool water and is conducted to filter 39 through drainpipe 38. The crud present in the pool water is removed by filter 39 and cleaned pool water is returned into wash chamber 31 from the top through pump 41 and delivery pipe 42.

An ultrasonic cleaning device constructed as above is subject to the following problems:

(1) In the case of this device also, the channel box is to be removed from fuel assembly 32 or cleaning is to be carried out with a fuel assembly which does not have a channel box. Thus, as in the case of the prior art water jet device described above, a complicated operation is inevitable and there is a risk of damaging the fuel rods.

(2) The ultrasonic transducer is arranged in the wash chamber together with the fuel assembly so the ultrasonic transducer is contaminated by radioactive substances, etc. and so comes to constitute radioactive waste.

(3) Optimum conditions for ultrasonic irradiation are not considered so that high cleaning efficiency is not possible.

Furthermore, regarding cleaning of the fuel rack, which is a square shaped hollow item, methods are employed such as removing solids adhering thereto by spraying with high pressure water, by inserting water jet nozzles in the same way as with the fuel assembly on the inside surface of the tube into which the fuel is inserted. However, as in the case of fuel assembly cleaning, large quantities of highly pressurized water are required. This means that equipment such as pumps has to be made of a large size, making it difficult to manipulate and posing problems regarding installation space and contamination of the device itself, as well as raising concerns that a large quantity of radioactive waste will ensue.

As described above, with a water jet system, crud adhering to fuel rods which are positioned on the inside of the hollow square-shaped item constituted by a fuel assembly is not removed. Furthermore, because the cleaning is accompanied by an operation to remove and refit the channel box before and after cleaning, this requires a large amount of time and there is a risk of damaging the fuel during removal and refitting of the channel box. The large size of the equipment is also a concern. Also in the case of a cleaning device using ultrasonic waves, removal and refitting of the channel box is considered necessary, and, since the ultrasonic transducer is arranged within the water chamber in which the fuel assembly constituting the hollow square-shaped article to be cleaned is placed, it becomes contaminated, creating a problem of radioactive waste disposal.

SUMMARY OF THE INVENTION

An object of the invention is to provide an ultrasonic cleaning method and a device therefor which is capable of achieving highly efficient uniform cleaning of solid material such as radioactive crud which strongly adheres to a hollow, square fuel assembly or spent fuel rack yet which has no adverse effect at all on fuel, etc. stored at the periphery of the pool where cleaning is performed.

In order to achieve the above object, there is provided an ultrasonic cleaning method comprising steps of: supplying cleaning liquid into the tube irradiating ultrasonic waves toward the tube, which contains the cleaning liquid, from at least two directions toward each of said side walls; and discharging the cleaning liquid from the tube after the step of irradiating.

Further, there is provided an ultrasonic cleaning apparatus for cleaning inside of a polygonal tube having an axis, which comprises: a plurality of ultrasonic transducers which irradiate ultrasonic waves toward the tube from at least two directions; a support member which supports the tube; an ultrasonic transducer transferring mechanism which moves said ultrasonic transducers along the axis of the tube; cleaning liquid supply means arranged outside the tube to supply cleaning liquid into the tube; and cleaning liquid discharge means which discharges the cleaning liquid from the tube.

Yet further there is provided an ultrasonic cleaning device as described above characterized in that it is equipped with an ultrasonic wave leakage prevention structure which cuts off leakage of ultrasonic waves from the ultrasonic transducers to areas external to the device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

An embodiment of an ultrasonic cleaning method according to this invention and a device therefor will now be described with reference to the drawings.

Figure 1:
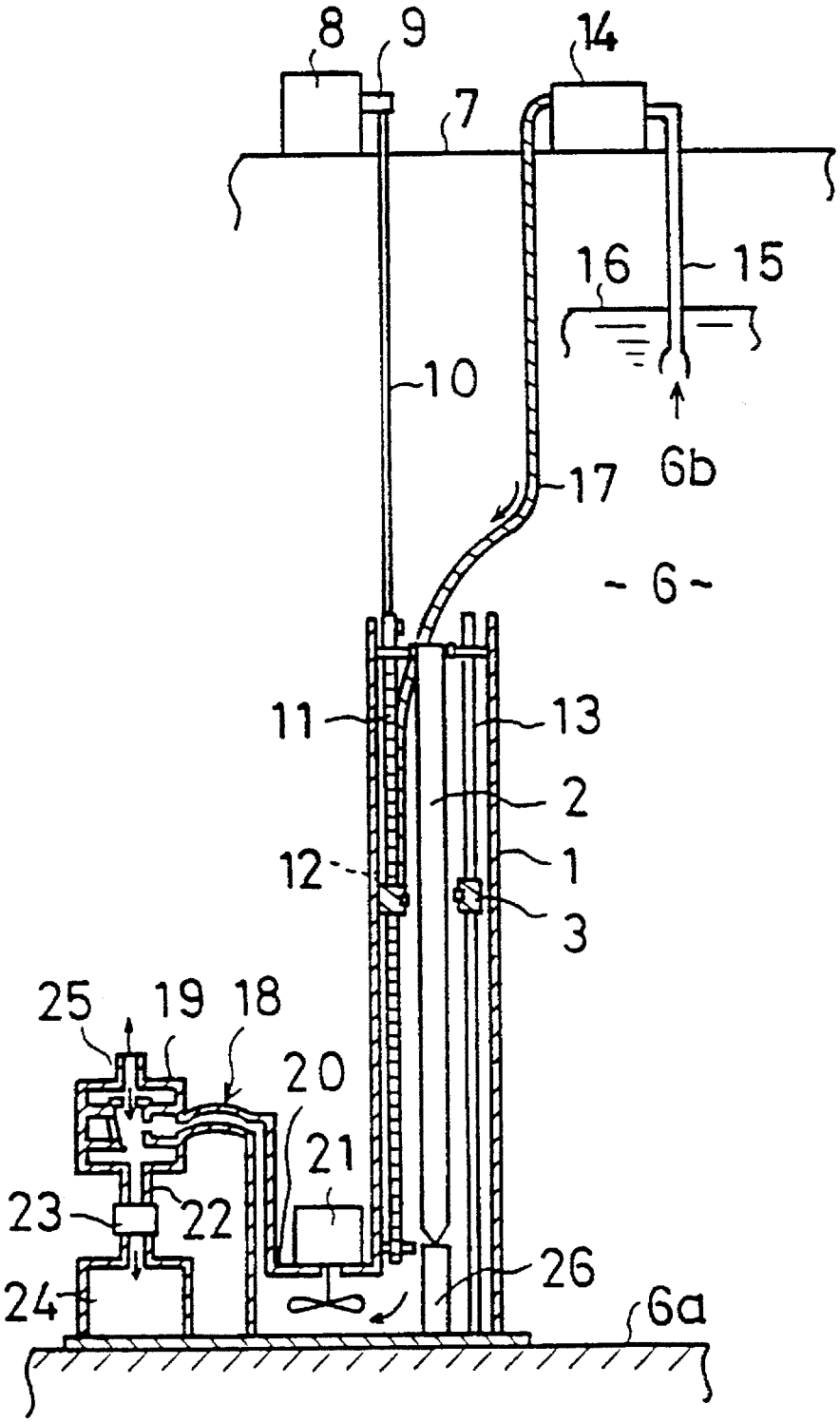
FIG. 1 (PRIOR ART)
FIG. 1 is a layout diagram showing the overall layout of a prior art water jet cleaning device.
Figure 2:
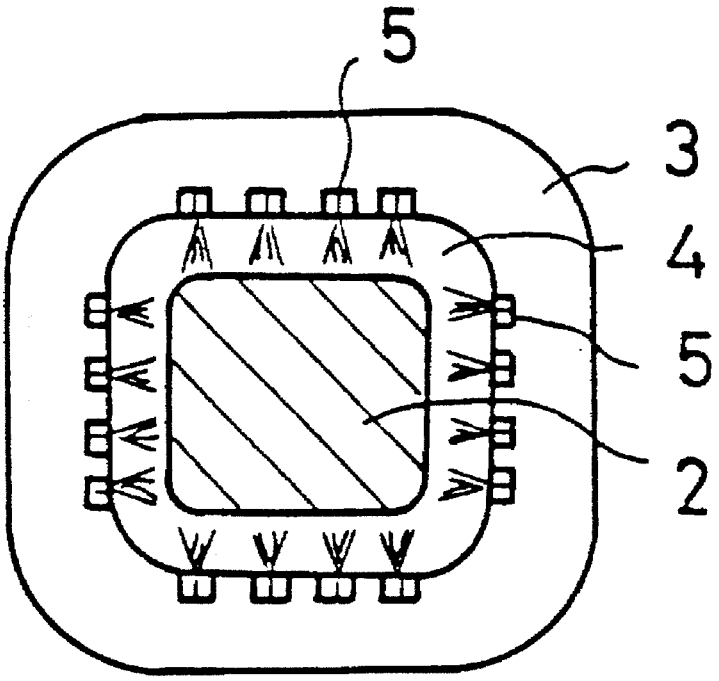
FIG. 2 (PRIOR ART)
FIG. 2 is a plan view showing the spray nozzle head used in FIG. 1 on a larger scale.
Figure 3:
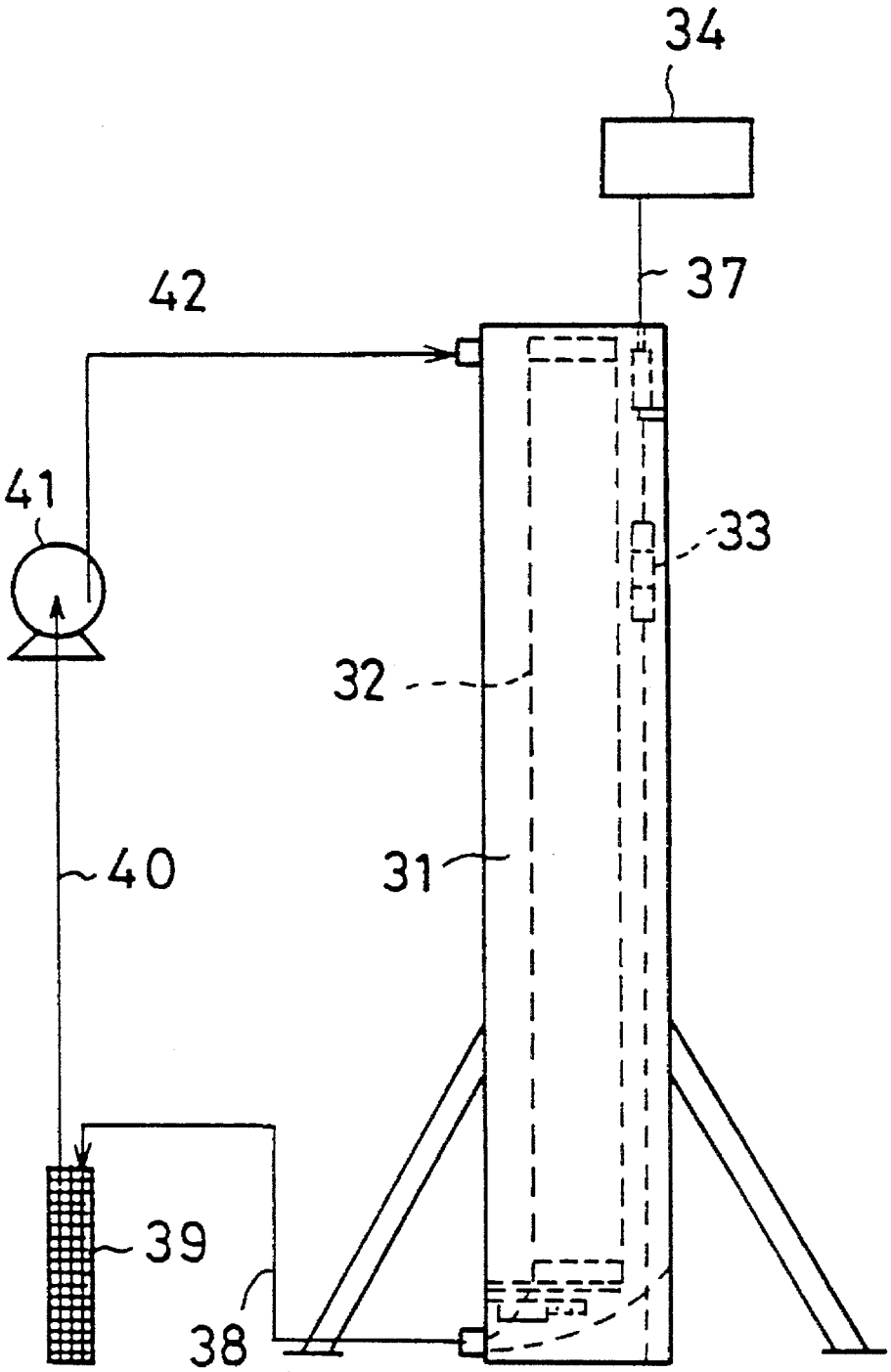
FIG. 3 (PRIOR ART)
FIG. 3 is an overall layout diagram showing a prior art ultrasonic cleaning device.
Figure 4:
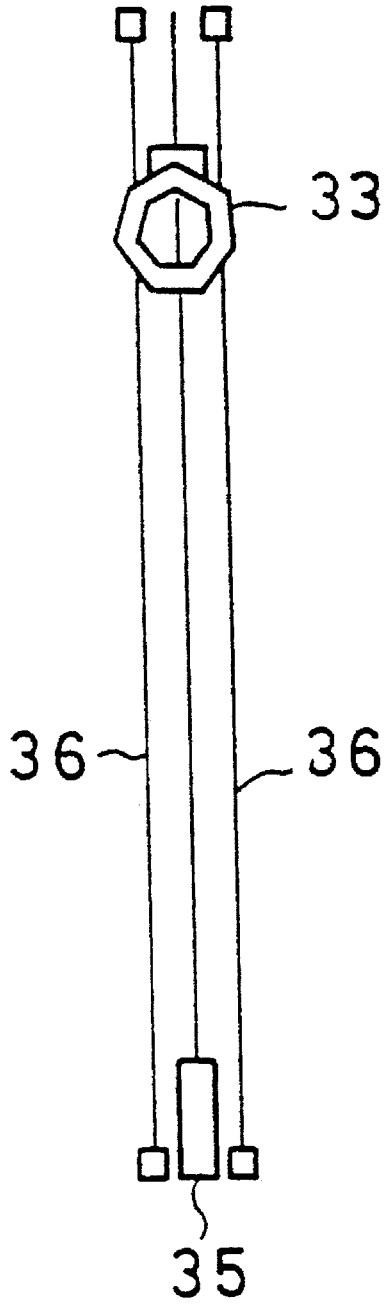
FIG. 4 (PRIOR ART)
FIG. 4 is a side view showing the ultrasonic transducers and the raising and lowering mechanism used in FIG. 3.
Figure 5:
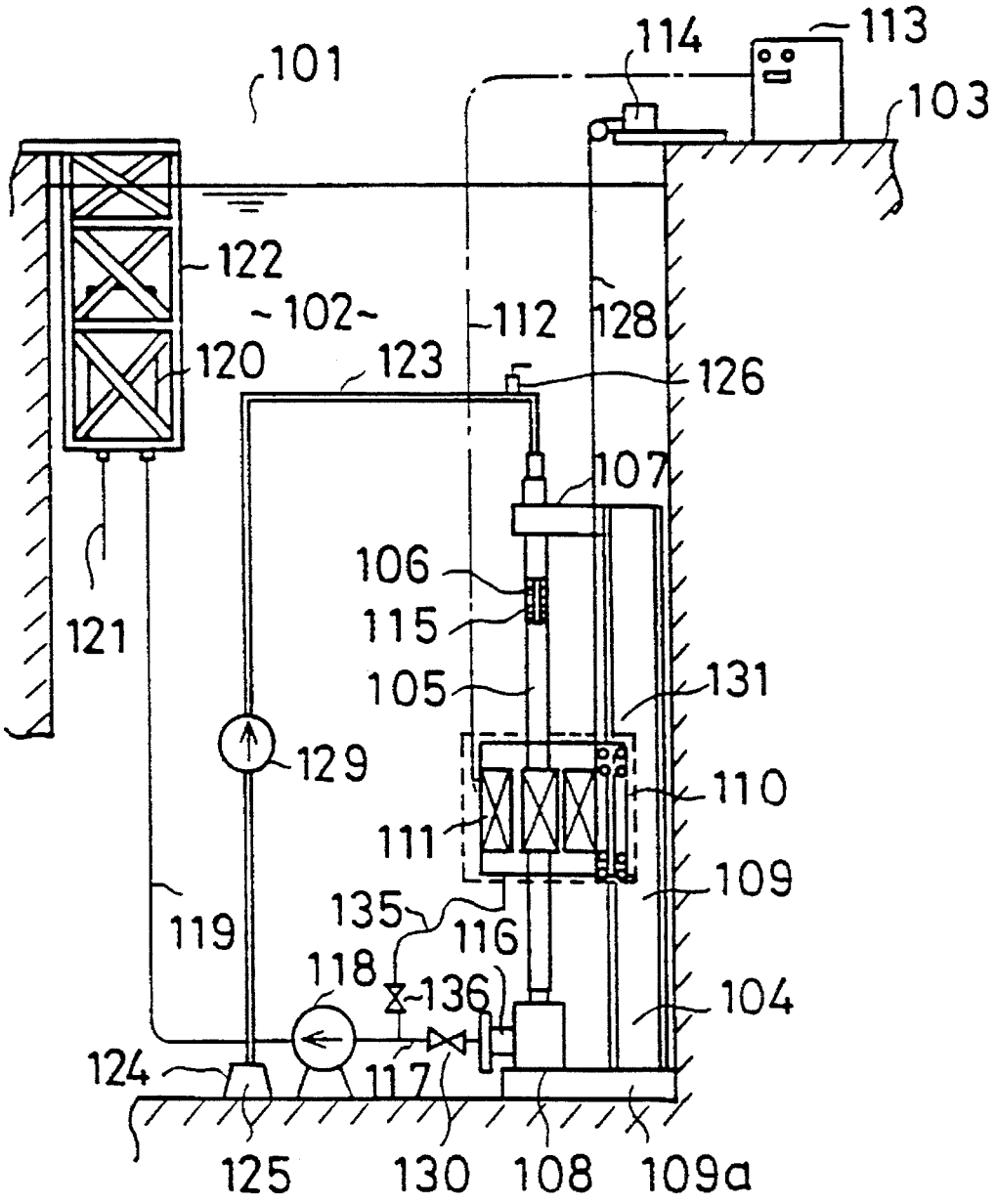
FIG. 5 is an overall layout diagram illustrating an ultrasonic cleaning device constituting an embodiment of this invention.

FIG. 5 is an example of the construction of an ultrasonic wave cleaning device when a first embodiment of this invention is applied to a fuel assembly. Reference numeral 101 in FIG. 5 is the fuel pool. Fuel pool water 102 is accommodated in this fuel pool 101. An operating floor 103 is provided above fuel pool 101. A fuel supporting structure 104 is arranged within this fuel pool 101. A fuel assembly 105 is supported with a channel box 106 mounted thereon. This fuel supporting structure 104 comprises a support stand 109 which supports an upper bundle support 107 and a lower bundle support 108. Support stand 109 stands on a base 109*a*. At the top of fuel assembly 105 is mounted a flexible manifold 123 for supplying pool water 102 of low dissolved gas concentration into channel box 106. A feed nozzle 124 for supplying cleaning liquid 125 of low dissolved gas concentration is arranged at the tip of manifold 123. Furthermore, on manifold 123 for supplying pool water 102 there is arranged a feed pump 129 for supplying pool water 102 to a plurality of fuel rods 115, which is equipped with a channel box 116 and a meter for monitoring the concentration of dissolved gas in pool water 102, specifically, a dissolved oxygen meter 126 for monitoring the oxygen concentration. An ultrasonic transducer translating mechanism 110 is mounted on support stand 109 in such a way that it can be raised and lowered. Ultrasonic transducers 111 arranged on this ultrasonic transducer translating mechanism 110 are connected through a cable 112 to an ultrasonic generator 113 arranged on operating floor 103.

The ultrasonic transducers 111 are held by ultrasonic transducer translating mechanism 110 and can be raised and lowered vertically with prescribed speed by means of raising and lowering mechanism 114 while maintaining the same irradiation surface of fuel assembly 105 and irradiating distance therefrom. Ultrasonic waves from ultrasonic transducers 111 arranged facing each of the faces of fuel assembly 105 are directed onto fuel assembly 105 with channel box 116 still mounted while raising and lowering ultrasonic transducer translating mechanism 110 by means of raising and lowering mechanism 114, thereby uniformly removing solids such as radioactive crud or scale adhering to the plurality of fuel rods 115 which are accommodated on the inside face of channel box 106 or inside channel box 106. The solids such as radioactive crud or scale which are removed are washed down inside channel box 106 by pool water 102 and are sucked out by discharge pump 118 through drain nozzle 116, adjusting valve 130 and drain pipe 117 connected to lower bundle support 108. The crud or scale is then transferred through delivery pipe 119 to crud collecting filter 120 where the solids in pool water 102 are thus removed. Cleaned fuel pool water 102 from which the solids have been removed is then again discharged into fuel pool 101 through pipe 121. Ease of handling and safety with respect to filter 120 may be further ensured by supporting it on a filter holder, if required.

The above outlines the method of ultrasonic cleaning according to this embodiment and a device therefor. In the above embodiment, pool water 102 of low dissolved gas concentration was taken in from the top of fuel assembly 105 but there would be no problem in providing a suction nozzle 130 at the foot of fuel assembly 105. Further, as the method of moving over the surface to be irradiated by ultrasonic waves, an example was described in which ultrasonic transducers 111 were raised and lowered, but there would be no problem in raising a lowering fuel assembly 105 itself.

Figure 6:
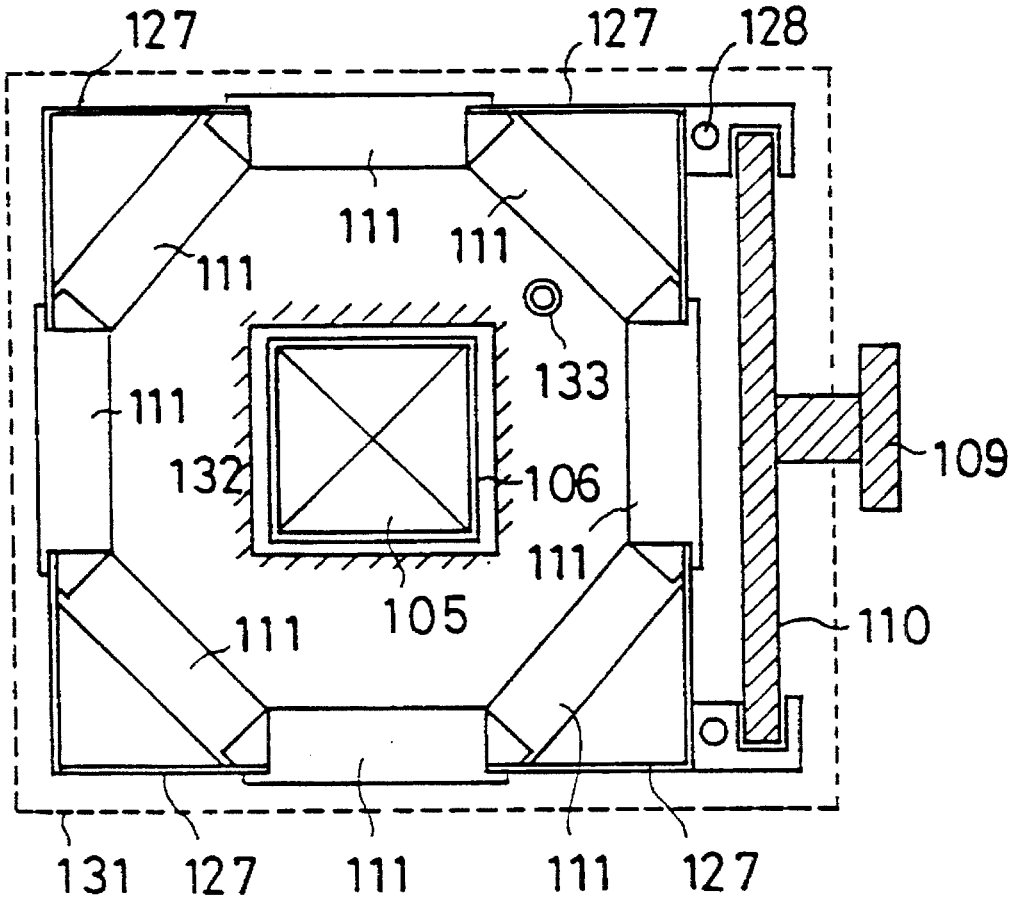
FIG. 6 is a plan view showing the construction of an ultrasonic transducer translating mechanism used in FIG. 5.
Figure 7:
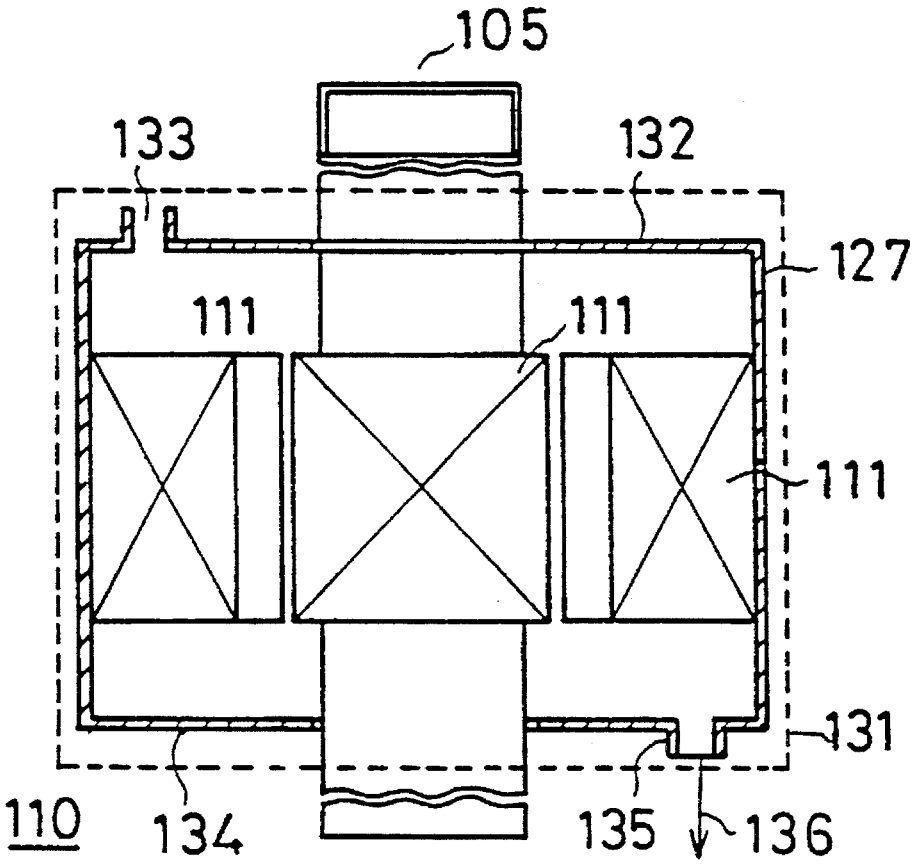
FIG. 7 is a longitudinal sectional view of the ultrasonic transducer translating mechanism shown in FIG. 6.

The layout of ultrasonic transducer translating mechanism 110 is shown in FIG. 6 and FIG. 7. FIG. 6 shows a layout of ultrasonic transducer translating mechanism 110 as seen from above. FIG. 7 is an axial cross-sectional view of this mechanism 110. Reference numeral 127 in FIG. 6 denotes an ultrasonic wave reflecting structure steel housing which covers ultrasonic transducers 111 which are mounted on ultrasonic transducer translating mechanism 110. Steel housing 127 is employed so that any of the ultrasonic waves generated by ultrasonic transducers 111 which have not passed through channel box 116 are again reflected by steel housing 127 so that they are once more passed into channel box 106. In this constructional example, the method is adopted of arranging ultrasonic transducers 111 in a row on the inside of steel housing 127 with their directions of irradiation mutually offset by 45° angles, so that the ultrasonic waves which are emitted from ultrasonic transducers 111 towards the four sides of channel box 106 are incident from a perpendicular (90°) and a 45° direction onto each side face of channel box 106. These ultrasonic transducers 111 are connected to an ultrasonic generator 113 by means of cable 112.

On upper cover 132 of steel housing 127 there is provided an intake 133 for intake of pool water 102 into the housing. In lower cover 134 there is provided an outlet 135 for outlet of pool water 102 which has been taken in. Outlet 135 is connected to discharge pump 118 through pipe 136. With this construction, contamination of ultrasonic transducers 111 can be reduced, since even if there should be any solids adhering to the outside of channel box 106, separation of such solids by ultrasonic irradiation cannot result in leakage of such separated solids to the periphery of pool 101, such solids being reliably collected by crud collecting filter 120. Additionally, around the periphery of steel housing 127 there is provided an ultrasonic wave leakage prevention structure 131 for preventing leakage and diffusion of ultrasonic waves to pool 101 by passing through steel housing 127. Ultrasonic wave leakage prevention structure 131 is constructed to cover the entire steel housing 127. Since, if the thickness of steel housing 127 is too small, ultrasonic waves can pass through it unaffected, a housing made of stainless steel of at least 0.5 cm thickness is employed. Also a raising and lowering wire 128 is attached to raising and lowering mechanism 114 for raising and lowering ultrasonic transducer translating mechanism 110 vertically, thereby making it possible to perform irradiation with ultrasonic waves while raising and lowering ultrasonic transducer raising and lowering mechanism 110 with prescribed speed.

Figure 8:
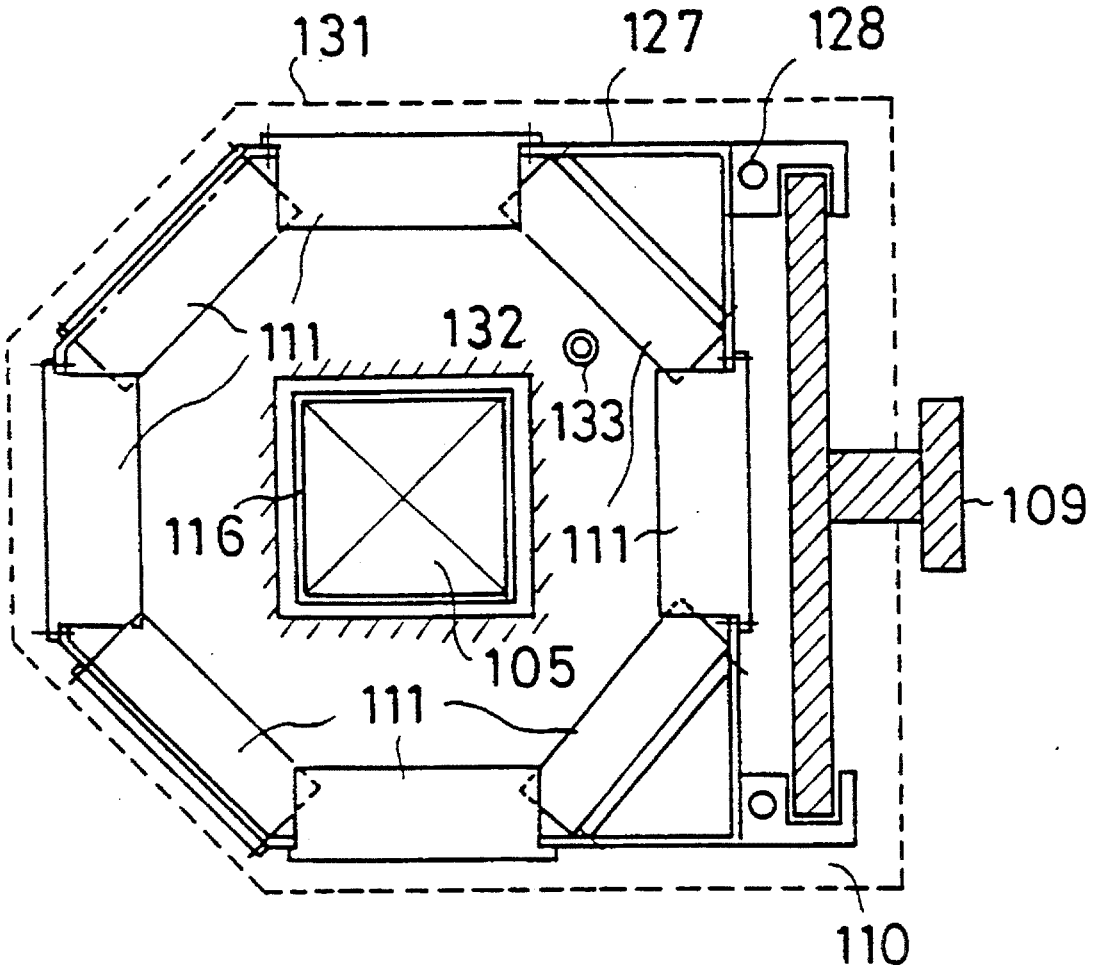
FIG. 8 is a plan view of an ultrasonic translating mechanism according to a further embodiment of this invention.
Figure 9:
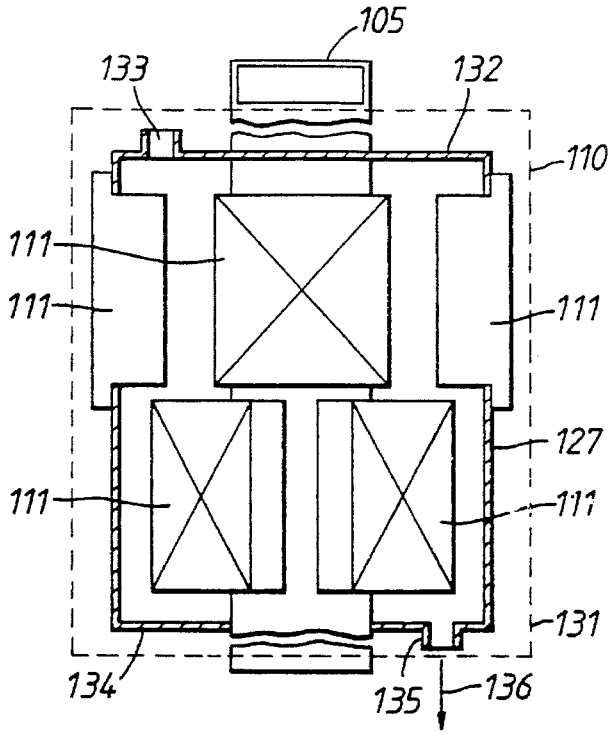
FIG. 9 is a longitudinal sectional view of the ultrasonic transducer translating mechanism shown in FIG. 8.

In the above embodiment, a method was described in which ultrasonic transducers 111 were arranged in a single row. However, as shown in FIG. 8 and FIG. 9, the same effect could be obtained by arranging ultrasonic transducers 111 in two rows of four transducers each, each row being offset by transducers by 45°. Furthermore, in this embodiment, a method was described wherein simultaneous cleaning can be performed of the four faces of fuel assembly 105 by irradiation at 90° and 45°. However, cleaning could likewise be performed by irradiation of two adjacent side faces (two faces at right angles) of the item to be cleaned with ultrasonic waves at 90° and 45°, the remaining two side faces being cleaned by rotating the fuel assembly or ultrasonic transducers by 180°. In this case the number of ultrasonic transducers can be cut to four.

Figure 10:
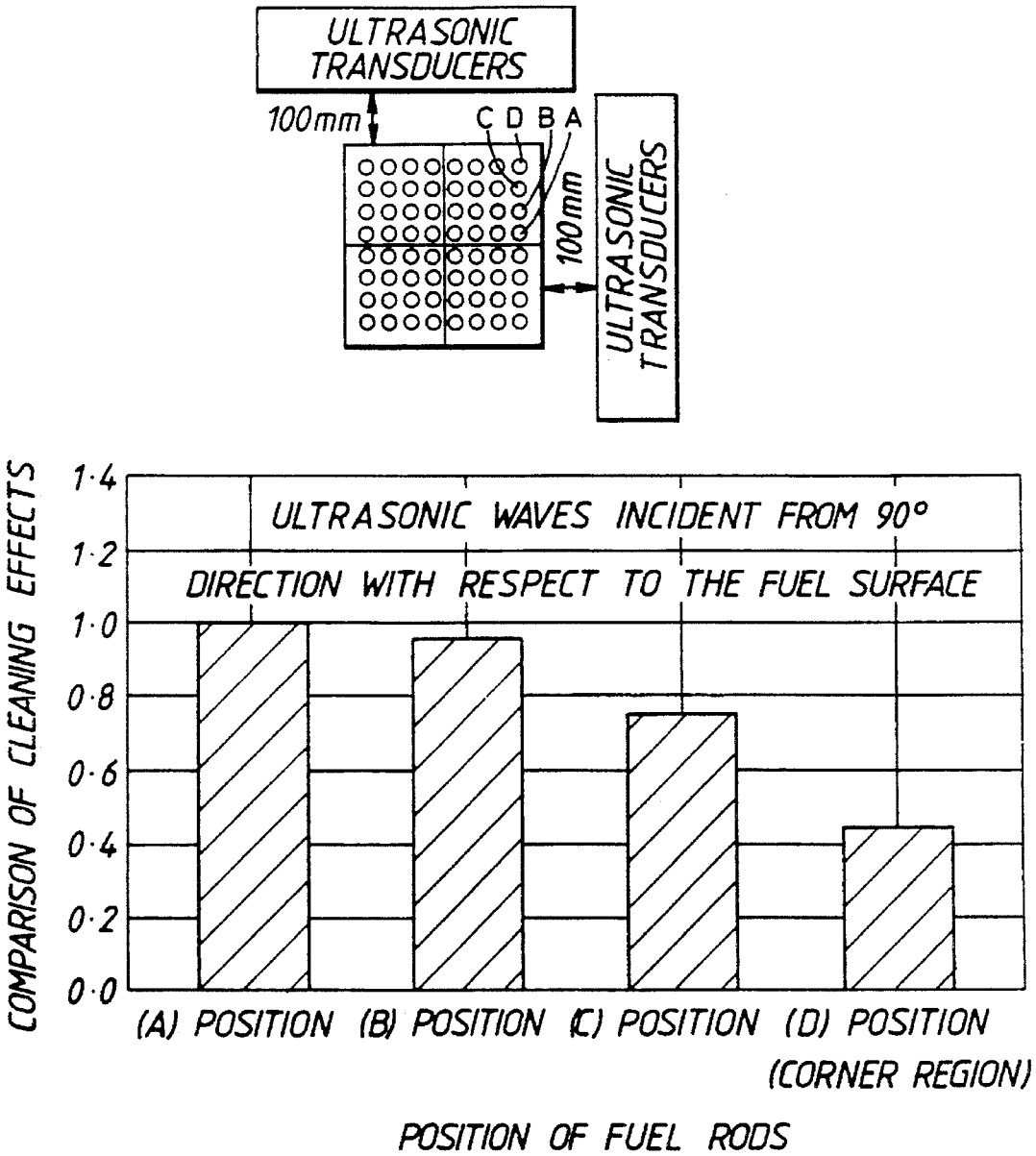
FIG. 10 shows a comparison of the crud cleaning effects for fuel rods in the central region and corner region when irradiated with ultrasonic waves from a perpendicular (90°) direction.

The reasons why irradiation with ultrasonic waves is carried out with the angle of direction of ultrasonic transducers 111 with respect to fuel assembly 105 being altered in 45° steps will now be described. FIG. 10 is a chart showing a relative comparison (i.e. a relative comparison taking the cleaning effect at fuel rod (A) at the center as being 1) between the cleaning effect and fuel rod position in the fuel assembly, when cleaning is performed by a method in which the ultrasonic waves emitted from ultrasonic transducers 111 towards the side faces of channel box 106 are incident at right angles (90°) onto channel box 106, the faces of ultrasonic transducers 111 being arranged parallel to fuel assembly 105. From these results it can be seen that, when the ultrasonic waves are incident from right angle directions with respect to the surface of fuel assembly 105, the efficiency of cleaning of the fuel rods at the edge corners drops in comparison with the efficiency of cleaning of the fuel rod at the center. In particular, there is a severe drop in cleaning efficiency of a fuel rod at the corner (position (D)). This is believed to be due to reasons such as that channel box 106 of fuel assembly 105 is not of perfect hollow square shape but is rounded at the corners. The angle of incidence of the ultrasonic waves at these portions therefore deviating from 90°, causing a drop in the ultrasonic wave transmissivity (increased ultrasonic wave reflection) or that the ultrasonic wave intensity is lower for the edge region of ultrasonic transducers 111 than in the middle region.

Figure 11:
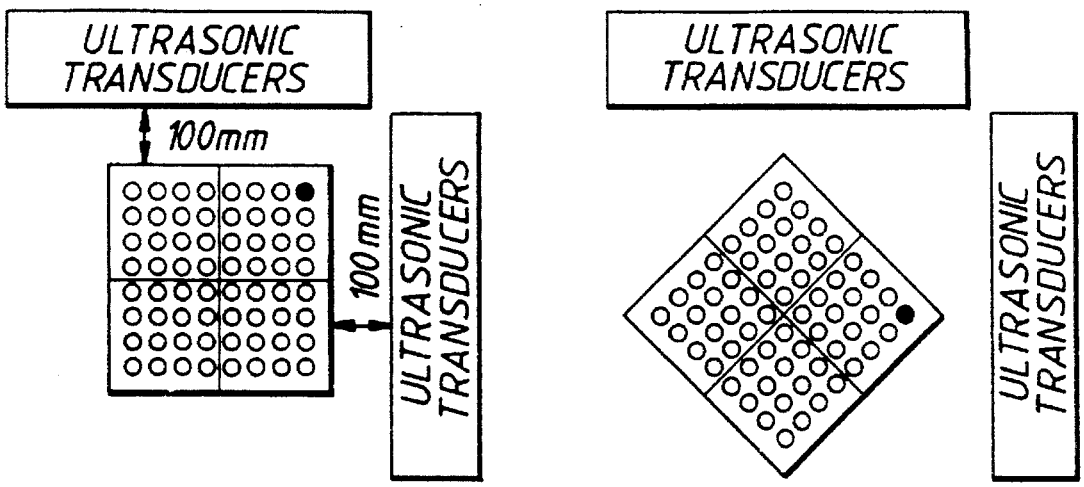
FIG. 11 shows a comparison of the crud cleaning effects for fuel rods in the corner region when irradiated with ultrasonic waves from the perpendicular (90°) direction and a 45° direction.
Figure 11:
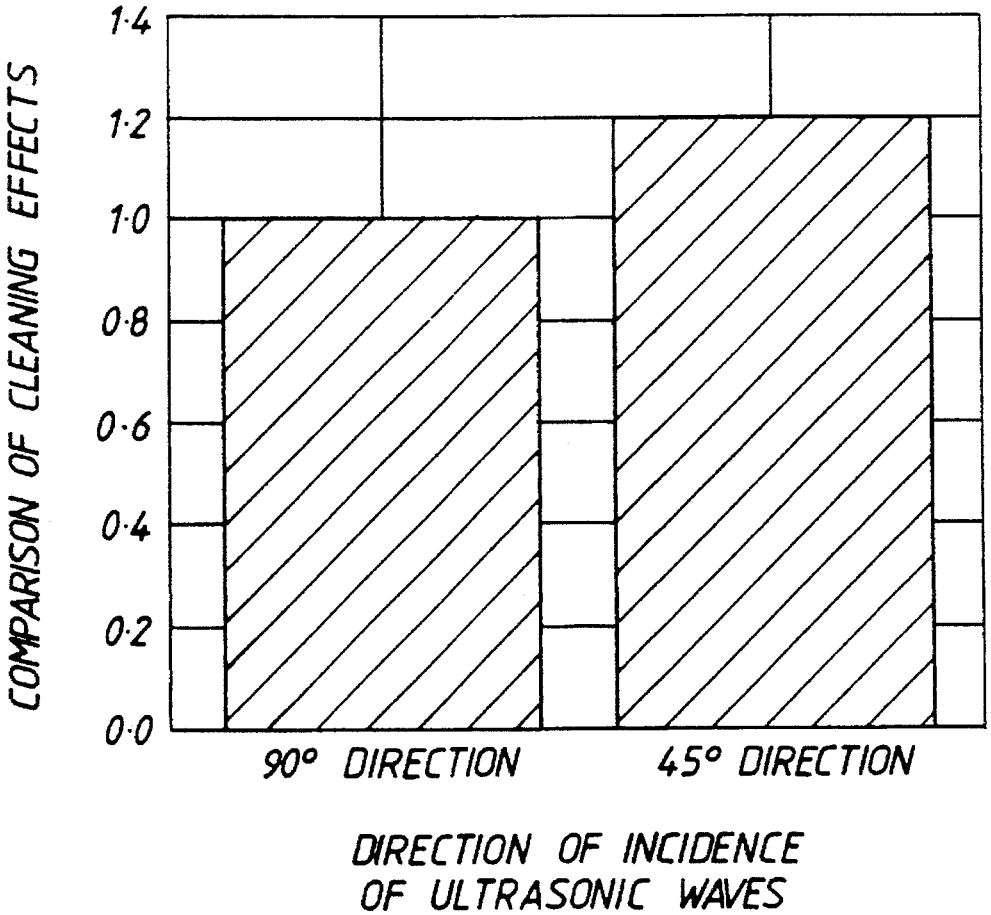

The test conditions were as follows: ultrasonic transducer frequency: 26 Hz; output 600 W/transducer, two transducers (perpendicular 2-face irradiation): irradiation distance (distance from the outside surface of the channel box to the ultrasonic transducer irradiating surface): 100 mm; simulation water depth 6 m; cleaning time: 3 min. The relationship between the position of the ultrasonic transducers and the position of the simulation fuel rods was as shown in FIG. 10. Next, the results obtained when ultrasonic wave cleaning was performed under the condition that the irradiating faces of ultrasonic transducers 111 are at 45° with respect to the side faces of fuel assembly 105 will be described. FIG. 11 shows the results of comparing the fuel rod cleaning effect in the corner region when the ultrasonic waves are incident from the 45° direction with the cleaning effect obtained when they are incident from the perpendicular direction (a comparison of the cleaning effect of the corner-region fuel rods designated by the symbol: black circle, when cleaned by irradiation with ultrasonic waves from the 90° direction, as 1).

The test conditions were the same as the conditions mentioned above: ultrasonic transducers used: frequency 26 Hz, output 600 W/transducer, 2 transducers (perpendicular 2-face irradiation); irradiation distance (distance from the outside surface of the corner of the channel box to the ultrasonic transducer irradiating surface): about 70 mm (distance when a channel box of irradiation distance 100 mm under perpendicular irradiation was rotated through 45°); simulation water depth 6 m; cleaning time of 3 min. It is clear from these results that, in order to clean off crud adhering to the fuel rods at the corner of fuel assembly 111 with high efficiency, it is much more effective to perform cleaning by directing the ultrasonic waves onto the channel box from an angle of 45° C. rather than from the perpendicular direction. The reasons for this are believed to be that, in the case of ultrasonic wave irradiation at 45, the corner region of fuel assembly 105 is located at the middle of ultrasonic transducers 111, where the ultrasonic wave intensity is high, and, compared with the parallel positional relationship, the corner region is closer to ultrasonic transducers 111. Ultrasonic waves can therefore pass through the channel box more readily and as a result the efficiency of crud cleaning is increased. An effective means of cleaning, with high efficiency and uniformity, the whole of a fuel assembly 105 with a channel box 106, constituting a square-shaped tubular body which is the item to be cleaned, still fitted is therefore a combination of the method of arranging the side face of fuel assembly 105 and the irradiation face (if ultrasonic transducers 111 in parallel for cleaning fuel rods positioned in the middle of fuel assembly 11 so that the ultrasonic waves are incident from the perpendicular 90° direction, and the method of arranging the side face of fuel assembly 105 and the irradiation face of ultrasonic transducers 111 at 45° so that the ultrasonic waves are incident from 45°.

Next, the reasons why, as for the ultrasonic wave reflecting structure of ultrasonic transducers unit 111 mounted on ultrasonic transducer translating mechanism 110, a steel housing cover 127 is provided covering all of the ultrasonic transducers, will be described. When ultrasonic waves are incident from the perpendicular (90° direction) with respect to channel box 106 from outside fuel assembly 105 with a zircalloy channel box 106 still fitted, the fraction (D) of ultrasonic waves which pass through channel box 106 can be found by the following formula:

$$D=1/\{4\cos^2(2\pi L/lambdal)+\{ZO/Z1/Z0)^2\cdot\sin^2(2\pi L/lambal)\}$$

In this expression, L is the channel box thickness, lambdal is the wavelength of the ultrasonic waves in the channel box, z is the characteristic acoustic impedance, and the subscript 0 represents cleaning liquid (water) while the subscript 1 represents the channel box. When ultrasonic waves of a frequency of 26 Hz are used, the proportion of ultrasonic waves passing through channel box 106 is about 50%; the remaining ultrasonic waves being reflected towards the pool periphery without passing through channel box 106. These reflected ultrasonic waves are diffused and attenuated at the pool periphery. The ultrasonic waves which were conventionally wasted can therefore be utilized more effectively by the provision of means to reflect the ultrasonic waves reflected from channel box 106 back again at steel housing 127 in the direction of channel box 106 so that they are again incident on channel box 106, by covering the periphery of ultrasonic transducers 111 (including in the vertical direction) by an ultrasonic wave reflecting structure constituted by steel housing 127. Thus by covering the ultrasonic wave reflecting region by ultrasonic wave reflecting structure 127, diffuse reflection of the ultrasonic waves can be repeatedly carried out within ultrasonic wave reflecting structure 127, i.e., between the ultrasonic transducers and channel box 106. This enables the cleaning efficiency to be raised since the ultrasonic waves can be utilized more effectively than hitherto known.

Figure 12:
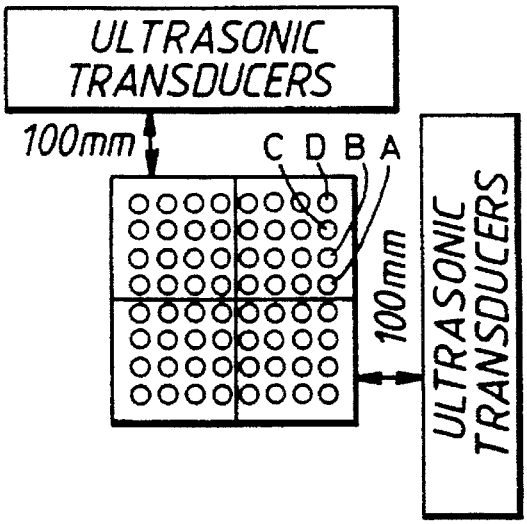
FIG. 12 is a characteristic showing a comparison of the crud cleaning effect for fuel rods depending on whether a steel housing is present or not.
Figure 12:
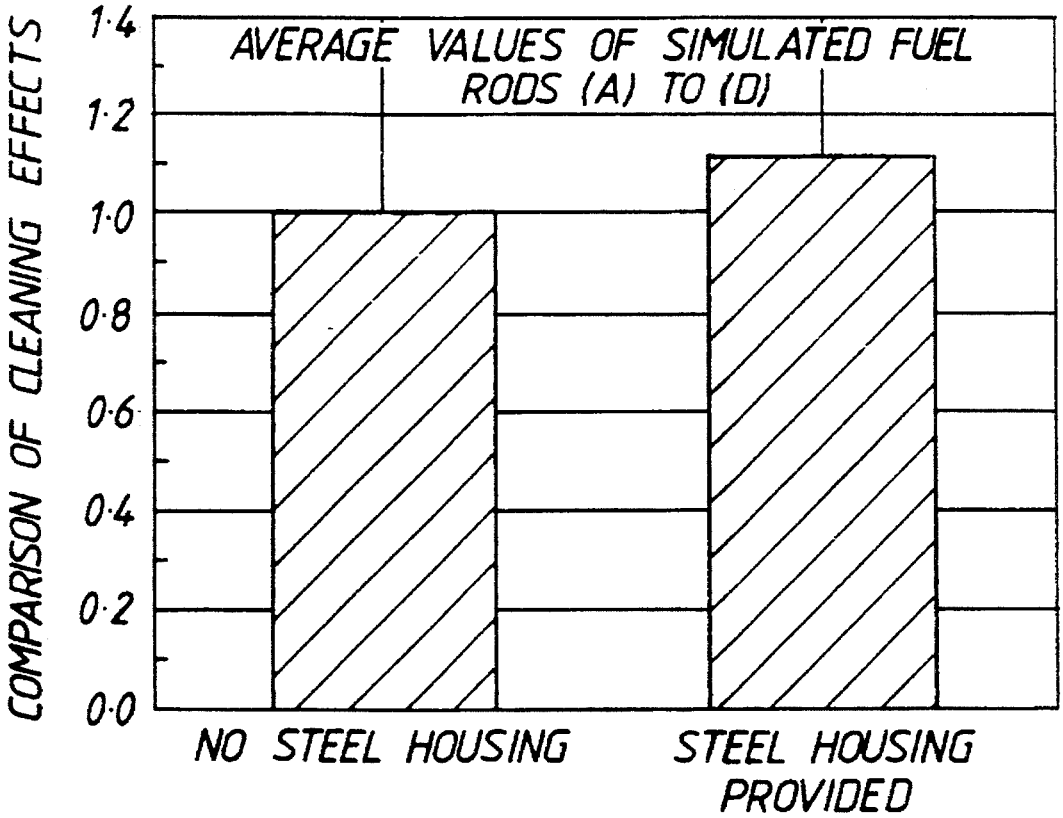

To verify the benefit of providing ultrasonic wave reflecting structure 127, FIG. 12 shows the results of ascertaining the difference in cleaning efficiency depending on whether or not a steel housing 127 for ultrasonic wave reflection is provided (in this case a housing with a stainless steel square cover of thickness 0.5 cm was used). (In the comparison, the cleaning effect when no steel housing was fitted was taken as 1). The test conditions were the same as hitherto: ultrasonic transducer frequency: 26 Hz, output 600 W/transducer, 2 transducers (perpendicular 2-face irradiation); irradiation distance (distance from the outside surface of the channel box to the ultrasonic transducer irradiating surface): 100 mm; simulation water depth 6 m; cleaning time: 3 min. These results confirm that fuel rod cleaning efficiency can be raised by covering ultrasonic transducers 111 by a steel cover 127 constituting an ultrasonic wave reflecting structure. They show that the provision of ultrasonic wave reflecting structure 127 is an effective means of cleaning a plurality of fuel rods inside fuel assembly 105 with better efficiency since it increases the amount of ultrasonic waves which pass through channel box 106 by enabling ultrasonic waves, some of which are reflected from channel box 106 of fuel assembly 105, to be reflected again towards fuel assembly 105 within the ultrasonic reflecting structure constituted by steel housing 127. It should be noted that although a square steel housing was employed as steel housing 127, there would be no problems at all if it were in particular cylindrical in shape, for example.

Next, regarding the thickness of steel housing 127 which constitutes the ultrasonic wave reflector, if stainless steel is used, from the above formula, when the thickness is 0.1 cm about 20% of the ultrasonic waves thrown back by the channel box can be reflected; if the thickness is 0.5 cm, about 80% can be reflected, and if it is 1 cm, about 95% can be reflected. It can therefore be seen that if the thickness of steel housing 127 is made at least 0.5 cm, 80% or more of the ultrasonic waves can be reflected, enabling the ultrasonic waves to be efficiently utilized.

Next, the reasons why an ultrasonic wave leakage preventing structure 131 is in turn arranged outside steel housing 127 provided with the object of reflecting the ultrasonic waves, covering this entire steel housing, will be described. As described above, steel housing 127 which reflects the ultrasonic waves serves to ensure that the ultrasonic waves are effectively utilized by reflecting back again to channel box 106 ultrasonic waves which are reflected by channel box 106. However, as mentioned above, it is not possible for the ultrasonic waves to be completely reflected by steel housing 127, so some of the ultrasonic waves which strike steel housing 127 in fact pass through steel housing 127 and are diffused at the periphery of pool 101. A lot of used fuel, etc. is stored in pool 101, and there is some anxiety that pool water 102 may be contaminated by spalling of solids adhering to such used fuel if it is struck by ultrasonic waves. It therefore becomes extremely important to ensure that ultrasonic waves passing through steel housing 127 have no adverse effect on fuel stored at the periphery of pool 101.

To prevent this ultrasonic wave leakage, the method has been considered of preventing the passage of the ultrasonic waves by means of a lattice structure (e.g. stainless steel wire mesh) having a smaller pitch than the wavelength of the ultrasonic waves (in the case of 26 Hz, the wavelength in water is 50–60 mm). It has been established by experiment that the pitch of wire mesh capable of providing an effective countermeasure to leakage of ultrasonic waves of frequency 26 Hz is 1–3 mm, with a wire diameter in the range 0.25–0.5 mm. By arranging wire mesh 131 having an ultrasonic wave leakage prevention function around the entire circumference of steel housing 127, the intensity (sound pressure level) of the ultrasonic waves which leak and diffuse in to the periphery of pool 101 can be reduced by a factor of 1/25 to 1/75. This enables safety and reliability to be increased by solving the problem of leakage and diffusion of ultrasonic waves onto used fuel etc. stored at the periphery of pool 101.

Figure 13:
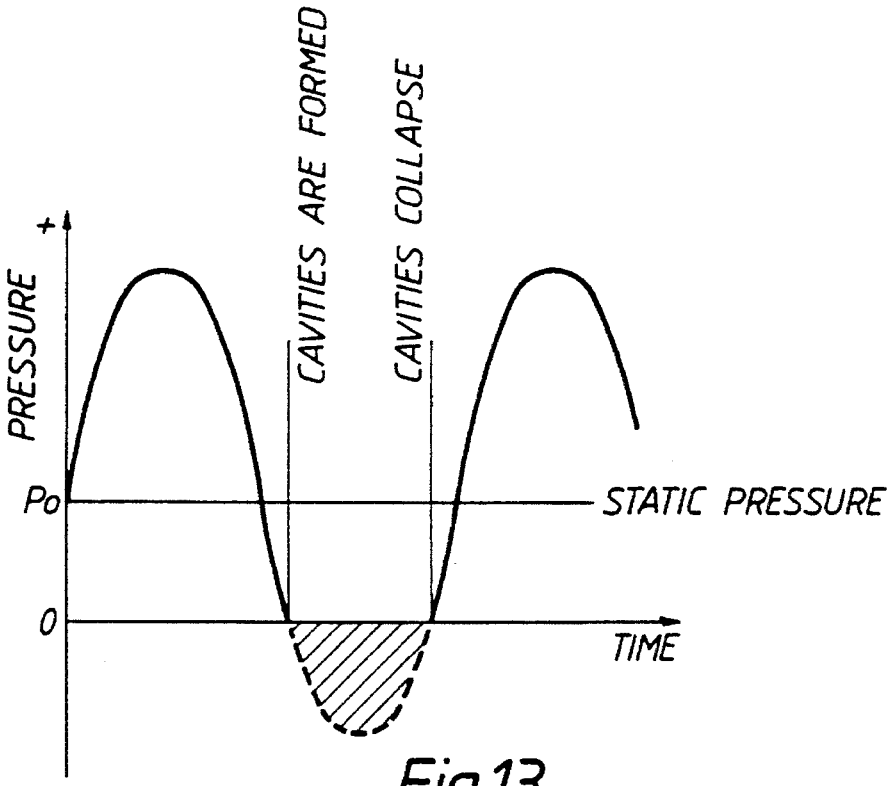
FIG. 13 is a characteristic showing the principle of cavitation by ultrasonic waves.

Next, the reasons for providing a device for raising the static pressure of pool water 102 flowing into channel box 106 of fuel assembly 105 will be explained. Cleaning techniques based on ultrasonic waves make use of cavitation (the phenomenon of pressure collapse of small cavities generated in the liquid) etc. produced by generation of ultrasonic waves in liquids. Cavitation is expressed as shown in FIG. 13. Ultrasonic waves are compressing waves and generate negative pressure if their amplitude exceeds the static pressure. However, since negative pressure does not exist, a force acts tearing the liquid apart to generate a vacuum (i.e., a cavity in the liquid in which solution is evaporated), which collapses with the subsequent compression. This is called "cavitation".

With this collapse, local flow (microjet) of the adjacent liquid is produced. Solids adhering to the fuel are separated by this cavitation and/or microjets occurring in the neighborhood of the fuel rod surface layer. Regarding such cavitation and microjets, if the static pressure of the liquid in the cleaning region (i.e., the location where the cavitation is generated) is raised i.e., the external pressure is raised, the speed of pressure collapse of the cavities when these collapse is increased, and this also raises the speed of the microjet flows. As a result, if these are generated in the vicinity of the surface layer of the fuel rods, a large spalling force can be applied to the solids adhering to fuel rods. Consequently, by raising the static pressure of the cleaning zone in fuel assembly 105 in channel box 106, powerful cavitation can be generated, making it possible to remove more strongly adhering solids than hitherto obtainable and so enabling a cleaning device of better cleaning efficiency to be provided.

Raising of the static pressure of the cleaning zone of fuel assembly 105 in channel box 106 is performed by adjusting the degree of opening of adjustment valve 130 which is arranged at the bottom end outlet of fuel assembly 105 and feed pump 129 arranged in part of manifold 123 for feeding pool water 102 connected to the top of fuel assembly 105. The pressure in fuel assembly 105 is raised by feed pump 129 by adjusting the inflow rate by means of adjustment valve 130, which is arranged at the bottom end of fuel assembly 105, fuel assembly 105 constituting the delivery side of feed pump 129. The set pressure can be verified by arranging a pressure meter (not shown) on this line. The static pressure in channel box 106 can easily be raised by this means.

Next, the reasons for introducing pool water 102 of low dissolved gas concentration into channel box 106 of fuel assembly 105 will be described. The principles of the cleaning with ultrasonic waves are as already described. Specifically, ultrasonic waves make use of cavitation etc. Consequently, if the cleaning liquid contains a lot of dissolved gas, this presents an obstacle to the generation of strong cavitation (vacuum condition) such as will not give rise to bubbles of the gas dissolved in the cleaning liquid at the instant when pressure is reduced. Therefore, in order to obtain a large cavitation force, to generate powerful cavitation it is important to use ultrasonic transducers 111 which produce a sufficiently strong output density (at least $1W/cm^2$) and to employ cleaning liquid pool water of a low dissolved gas amount. Crud adhering to the fuel rod surfaces can thereby be more effectively removed.

On examining the amount of dissolved gas (typically, the oxygen concentration) contained in the pool water of the fuel pool of the atomic power plant, it was found that the concentration of dissolved oxygen contained in pool water 102 in the region of the pool bottom was about one-half the dissolved oxygen concentration contained in the pool water at the pool surface layer. In this case powerful cavitation can therefore be generated in the vicinity of each of the fuel rods by supplying pool water 102 from pool bottom region 125 into channel box 106. Thus, this can be said to be an effective means for cleaning fuel assembly 105 with higher efficiency. Furthermore it is possible to get a reliable grasp of the cleaning condition since the concentration of dissolved oxygen contained in the feed water can be constantly monitored by providing a dissolved oxygen meter 126 at some location on this water supply line.

In the above discussion, as an example of a square-shaped hollow item, the case was described of cleaning a fuel assembly with a channel box still fitted. However, if, instead of a fuel assembly (channel box about 140 mm square, sheet thickness about 2.5 mm, length about 4 m) with channel box still fitted, the subject of cleaning is chosen to be a fuel rack unit tube (about 170 mm square, sheet thickness 6 mm, length about 4 m) occurring in construction work, etc. and having the same structure, solids adhering to the inside surface of the fuel rack unit tube can likewise be removed in a uniform manner and with high efficiency.

The following benefits can be obtained with this embodiment.

1. First of all, by irradiating the fuel assembly or fuel rack with channel box 106 still fitted, which is the square-shaped hollow item in this embodiment, with ultrasonic waves from the outside, solids such as strongly adhering crud adhering to the inside surface of the plurality of fuel rods 115 or fuel rack within channel box 106 can be cleaned away with higher efficiency than conventionally possible.

2. Also, since the operation of removing channel box 106 for cleaning the fuel assembly is unnecessary, the cleaning operation becomes much easier and the number of workers engaged can be reduced, thereby enabling the exposure dose associated with the task to be reduced.

3. Moreover, since there is never any need to manipulate fuel assembly 105 with channel box 106 removed, the risk of damaging fuel rods 115 is greatly reduced.

4. Furthermore, in this embodiment, the wash chamber which was conventionally required is unnecessary. In fact, in this invention, channel box 106 or the fuel rack itself performs the function of the conventional wash chamber. Consequently the device as a whole is simplified and made more compact. This is extremely beneficial from the standpoints of ensuring sufficient space and of cost.

5. In addition to elimination of the wash chamber, this invention provides cleaning with the channel box still fitted in position. There is therefore no direct contact between the ultrasonic transducers and radioactive solids. The quantity of radioactive waste generated can therefore be greatly reduced.

6. Also in the case of this embodiment the irradiation conditions of ultrasonic transducers 111 (ultrasonic wave irradiation angle, ultrasonic wave reflecting structure, increase in static pressure of the cleaning unit, and concentration of dissolved gas in the cleaning liquid) are set to optimum conditions, so removal of solids such as radioactive crud from square-shaped hollow items can be performed most effectively.

7. Moreover, the quantity of ultrasonic wave leakage and diffusion at the periphery of the pool during cleaning can be greatly reduced so there is no adverse effect of any kind on fuel located at the periphery, thus enabling safety, and reliability to be improved.

As described above, with the ultrasonic cleaning method and device therefor according to this invention, solids such as radioactive crud of strong adhesion adhering to the square-shaped hollow item to be cleaned, can be cleaned away safely and with high efficiency.

Numerous modifications and variations of the present invention are possible in light of the above teachings. It is therefore to be understood that, within the scope of the appended claims, the present invention can be practiced in a manner other than as specifically described herein.

What is claimed as new and is desired to be secured by Letters Patent of the United States is:

1. Ultrasonic cleaning device for cleaning an inside portion of a polygonal tube having an axis, the device comprising:

a plurality of ultrasonic transducers irradiating ultrasonic waves toward the tube from an exterior portion of the tube and from at least two directions;

a support member supporting the tube;

an ultrasonic transducer transferring mechanism moving said ultrasonic transducers along the axis of the tube;

a cleaning liquid supply mechanism arranged outside the tube, said supply mechanism supplying cleaning liquid into the tube;

a cleaning liquid discharge mechanism discharging the cleaning liquid from the tube; and an ultrasonic wave reflecting structure located at the exterior portion of the tube and which covers at least some of the ultrasonic transducers, said wave reflecting structure reflecting waves from the transducers towards the tube.

2. Ultrasonic cleaning device according to claim 1, wherein said ultrasonic wave reflecting structure covers each of the ultrasonic transducers.

3. Ultrasonic cleaning device according to claim 2, wherein said ultrasonic wave reflecting structure includes a steel housing having a thickness of at least 0.5 cm.

4. Ultrasonic cleaning device according to claim 1, which comprises an ultrasonic wave leakage prevention structure preventing leakage of ultrasonic waves from the ultrasonic transducers to areas external of the device.

5. Ultrasonic cleaning device according to claim 1, which comprises a monitoring mechanism monitoring oxygen concentration in said cleaning liquid.

6. Ultrasonic cleaning device according to claim 1, wherein said tube is hollow and has a square-shaped cross section.

7. Ultrasonic cleaning device according to claim 1, wherein said tube comprises a nuclear fuel channel box.

8. Ultrasonic cleaning device according to claim 1, wherein said tube comprises a nuclear fuel rack unit tube.

9. Ultrasonic cleaning device according to claim 1, which comprises a plurality of nuclear fuel rods positioned in said tube.

10. Ultrasonic cleaning device according to claim 1, wherein said tube has a plurality of side walls and a first group of said ultrasonics irradiate ultrasonic waves perpendicularly to at least one of said side walls of the tube and a second group of said transducers irradiate ultrasonic waves toward the tube in a substantially 45° angle direction relative to said at least one of said side walls of the tube.

11. Ultrasonic cleaning device according to claim 1, wherein said cleaning liquid supply mechanism includes a mechanism supplying cleaning liquid in a pressurized condition into the tube.

12. Ultrasonic cleaning device according to claim 1 wherein said ultrasonic wave leakage prevention structure comprises a wire mesh enclosure.

13. Ultrasonic cleaning device for cleaning an inside portion of a polygonal tube having an axis, the device comprising:

a plurality of ultrasonic transducers irradiating ultrasonic waves towards the tube from an exterior portion of the tube and from at least two directions;

a support member supporting the tube;

an ultrasonic transducer transferring mechanism moving said ultrasonic transducers along the axis of the tube;

a cleaning liquid supply mechanism arranged outside the tube, said supply mechanism supplying cleaning fluid into the tube;

a cleaning liquid discharge mechanism discharging the cleaning liquid from the tube; and an ultrasonic wave leakage prevention structure preventing leakage of ultrasonic waves from the ultrasonic transducers to areas external of the device wherein said ultrasonic wave leakage prevention structure comprises a stainless steel wire mesh enclosure.

14. Ultrasonic cleaning device for cleaning an inside portion of a polygonal tube having an axis, the device comprising:

a plurality of ultrasonic transducers irradiating ultrasonic waves toward the tube from an exterior portion of the tube;

a support member supporting the tube;

an ultrasonic transducer transferring mechanism moving said ultrasonic transducers along the axis of the tube;

a cleaning liquid supply mechanism located outside the tube, said supply mechanism supplying cleaning liquid under a pressurized condition into the tube; and a cleaning liquid discharge mechanism discharging the cleaning liquid from the tube; and an ultrasonic wave reflecting structure located at the exterior portion of the tube and which covers at least some of the ultrasonic transducers, said wave reflecting structure reflecting waves from the transducers towards the tube.

15. Ultrasonic cleaning device for cleaning an inside portion of a polygonal tube having an axis, the device comprising:

a plurality of ultrasonic transducers irradiating ultrasonic waves toward the tube from an exterior portion of the tube;

a support member supporting the tube;

an ultrasonic transducer transferring mechanism moving said ultrasonic transducers along the axis of the tube;

a cleaning liquid supply mechanism located outside the tube, said supply mechanism supplying cleaning liquid under a pressurized condition into the tube; and a cleaning liquid discharge mechanism discharging the cleaning liquid from the tube wherein said ultrasonic wave reflecting structure reflects ultrasonic waves from the ultrasonic transducers towards the tube.

16. Ultrasonic cleaning device according to claim 14, which comprises an ultrasonic wave leakage prevention structure preventing leakage of ultrasonic waves from the ultrasonic transducers to areas external to the device.

17. Ultrasonic cleaning device according to claim 14, wherein said tube is hollow and has a square-shaped cross section.

18. Ultrasonic cleaning device according to claim 14, wherein said tube comprises a nuclear fuel channel box.

19. Ultrasonic cleaning device according to claim 14, wherein said tube comprises a nuclear fuel rack unit tube.

20. Ultrasonic cleaning device according to claim 14, wherein a plurality of nuclear fuel rods are positioned in said tube.

21. Ultrasonic cleaning device according to claim 14 wherein said ultrasonic wave leakage prevention structure comprises a wire mesh enclosure.

22. Ultrasonic cleaning device for cleaning an inside portion of a polygonal tube having an axis, the device comprising:

a plurality of ultrasonic transducers irradiating ultrasonic waves toward the tube;.

a support member supporting the tubes;

an ultrasonic transducer transfering mechanism moving said ultrasonic transducer along the axis of the tube;

a cleaning liquid supply mechanism located outside the tube, said supply mechanism supplying cleaning liquid under a pressurized condition into the tube;

a cleaning liquid discharge mechanism discharging the cleaning liquid from the tube; and a monitoring mechanism monitoring oxygen concentration in said cleaning liquid.

23. Ultrasonic cleaning device for cleaning an inside portion of a polygonal tube having an axis, the device comprising:

a plurality of ultrasonic transducers irradiating ultrasonic waves towards the tube from an exterior portion of the tube;

a support member supporting the tube;

an ultrasonic transducer transferring mechanism moving said ultrasonic transducers along the axis of the tube;

a cleaning liquid supply mechanism located outside the tube, said supply mechanism supplying cleaning liquid under a pressurized condition into the tube; and a cleaning discharge mechanism discharging the cleaning liquid from the tube wherein said ultrasonic wave leakage prevention structure comprises a stainless steel wire mesh enclosure.

* * * * *